US009035796B2

(12) United States Patent
Pilutti et al.

(10) Patent No.: US 9,035,796 B2
(45) Date of Patent: May 19, 2015

(54) REDUCE SPEED AHEAD INFORMATION DELIVERY

(75) Inventors: Thomas Edward Pilutti, Ann Arbor, MI (US); Amin Kashi, Ann Arbor, MI (US); Marc Roeber, Düsseldorf (DE)

(73) Assignee: Ford Global Technologies, Dearborn, MI (US)

( * ) Notice: Subject to any disclaimer, the term of this patent is extended or adjusted under 35 U.S.C. 154(b) by 187 days.

(21) Appl. No.: 13/290,274

(22) Filed: Nov. 7, 2011

(65) Prior Publication Data

US 2013/0113633 A1 May 9, 2013

(51) Int. Cl.
*G08G 1/0967* (2006.01)

(52) U.S. Cl.
CPC .... *G08G 1/096716* (2013.01); *G08G 1/096758* (2013.01); *G08G 1/096783* (2013.01)

(58) Field of Classification Search
CPC ..... G08G 1/096716; G08G 1/096741; G08G 1/096783; G08G 1/0967; G08G 1/096725; G08G 1/096775; B60K 31/185
USPC ..... 340/901–905, 988–996; 701/1, 701/117–119, 31.4, 32.3–32.4, 33.2–33.4, 701/400–431, 538–541
See application file for complete search history.

(56) References Cited

U.S. PATENT DOCUMENTS

| | | | | |
|---|---|---|---|---|
| 6,008,740 | A * | 12/1999 | Hopkins | 340/905 |
| 6,388,578 | B1 * | 5/2002 | Fagan et al. | 340/901 |
| 6,472,977 | B1 * | 10/2002 | Pochmuller | 340/425.5 |
| 6,515,596 | B2 | 2/2003 | Awada | |
| 6,633,811 | B1 * | 10/2003 | Aumayer | 701/409 |
| 6,778,074 | B1 * | 8/2004 | Cuozzo | 340/441 |
| 7,589,643 | B2 | 9/2009 | Dagci | |
| 7,711,468 | B1 | 5/2010 | Levy | |
| 2002/0173881 | A1 * | 11/2002 | Lash et al. | 701/1 |
| 2004/0075582 | A1 * | 4/2004 | Bergan et al. | 340/936 |
| 2004/0088105 | A1 * | 5/2004 | Craine | 701/200 |
| 2005/0280552 | A1 * | 12/2005 | DiPiazza | 340/905 |
| 2007/0001830 | A1 * | 1/2007 | Dagci et al. | 340/438 |
| 2007/0050130 | A1 * | 3/2007 | Grimm et al. | 701/208 |
| 2010/0207787 | A1 * | 8/2010 | Catten et al. | 340/905 |
| 2010/0217494 | A1 | 8/2010 | Heft | |
| 2010/0324775 | A1 * | 12/2010 | Kermani et al. | 701/33 |

(Continued)

FOREIGN PATENT DOCUMENTS

| | | | | |
|---|---|---|---|---|
| WO | WO 99/26213 | A1 * | 5/1999 | G08G 1/0967 |
| WO | WO 2011/066850 | A1 * | 6/2011 | G01C 21/26 |

*Primary Examiner* — Hai Phan
*Assistant Examiner* — Orlando Bousono
(74) *Attorney, Agent, or Firm* — Angela M. Brunetti; Frank MacKenzie

(57) ABSTRACT

A navigation system provides a position of the vehicle on a segment of a roadway and identifies a change in speed limit relative to the current segment of the roadway. A traffic sign recognition system determines a speed limit information presentation zone of the current segment of the roadway after determining that a speed limit of the approaching segment of the roadway is lower than a speed limit of the current segment of the roadway and/or a current speed of the vehicle. Thereafter, the traffic sign recognition system assesses the position of the vehicle relative to the speed limit information presentation zone. In response to determining that the vehicle is within the speed limit information presentation location, the traffic sign recognition system displays a visual representation of a speed limit sign designating the speed limit of the approaching segment of the roadway.

19 Claims, 3 Drawing Sheets

(56) References Cited

U.S. PATENT DOCUMENTS

2011/0010042 A1* 1/2011 Boulet et al. ..... 701/33
2011/0121993 A1* 5/2011 Davis et al. ..... 340/911
2011/0288770 A1* 11/2011 Greasby ..... 701/208
2011/0301802 A1* 12/2011 Rupp et al. ..... 701/29

* cited by examiner

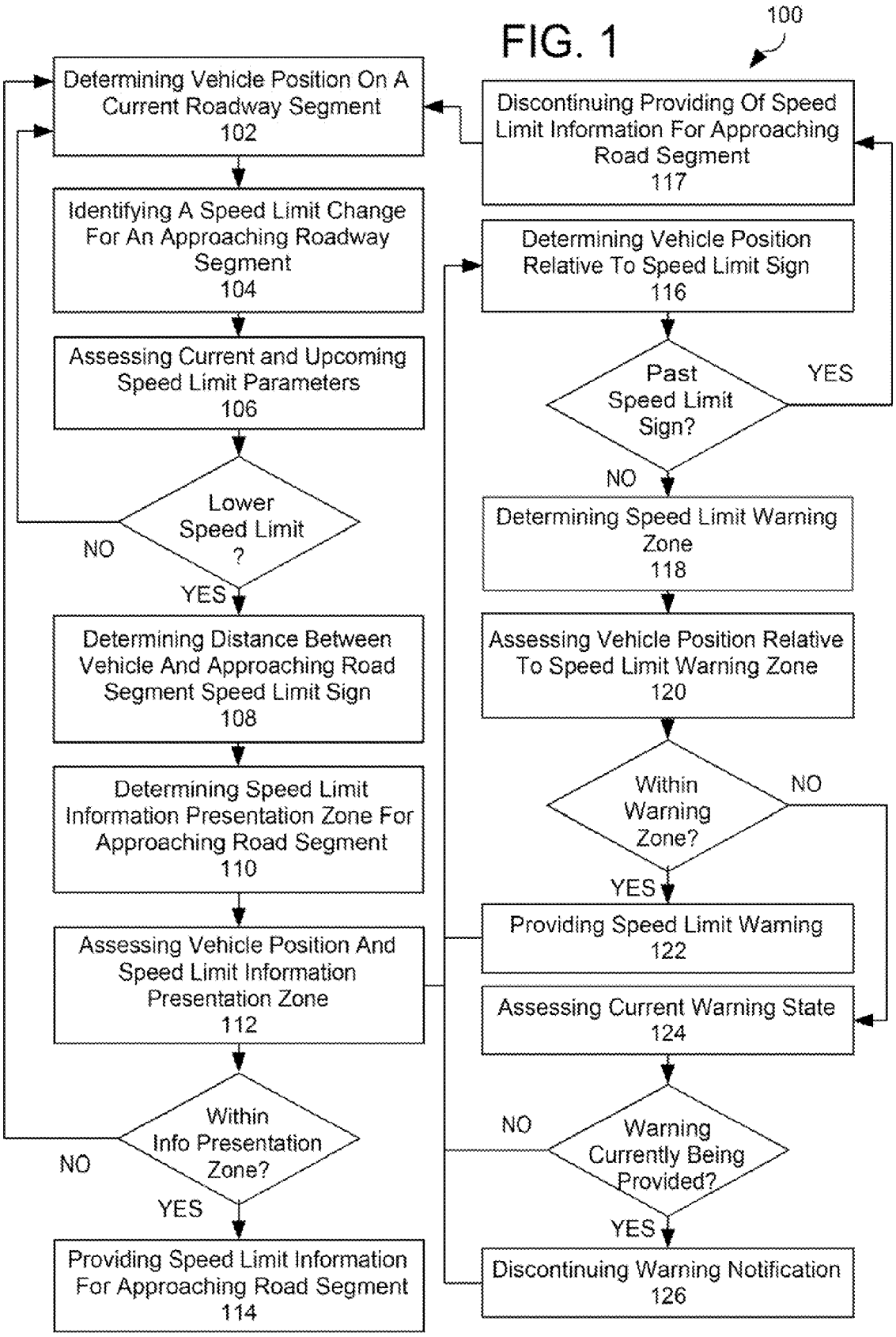
FIG. 1
100
Determining Vehicle Position On A Current Roadway Segment 102
Identifying A Speed Limit Change For An Approaching Roadway Segment 104
Assessing Current and Upcoming Speed Limit Parameters 106
Lower Speed Limit ?
NO
YES
Determining Distance Between Vehicle And Approaching Road Segment Speed Limit Sign 108
Determining Speed Limit Information Presentation Zone For Approaching Road Segment 110
Assessing Vehicle Position And Speed Limit Information Presentation Zone 112
Within Info Presentation Zone?
NO
YES
Providing Speed Limit Information For Approaching Road Segment 114
Discontinuing Providing Of Speed Limit Information For Approaching Road Segment 117
Determining Vehicle Position Relative To Speed Limit Sign 116
Past Speed Limit Sign?
YES
NO
Determining Speed Limit Warning Zone 118
Assessing Vehicle Position Relative To Speed Limit Warning Zone 120
Within Warning Zone?
NO
YES
Providing Speed Limit Warning 122
Assessing Current Warning State 124
Warning Currently Being Provided?
NO
YES
Discontinuing Warning Notification 126

REDUCE SPEED AHEAD INFORMATION DELIVERY

FIELD OF THE DISCLOSURE

The disclosures made herein relate generally to vehicle driver aids and, more particularly, to providing information and warnings relating to a speed limit of an approaching segment of a roadway.

BACKGROUND

Signage indicating a reduction in the legal (e.g., posted) speed limit for an upcoming segment of roadway is common in certain parts of the world such as, for example, in the United States (US). Such a sign is referred to herein as a reduce speed ahead (RSA) sign. The intent of such a sign is to give a driver an advanced indication that they will need to reduce the speed of their vehicle to accommodate a speed limit (i.e., as indicated by a speed limit sign) of an approaching segment of the roadway that is less than a speed limit for a current segment of the roadway over which they are travelling. In this regard, RSA signs are beneficial with regard to roadway safety and to violations for speeding. However, it is also known that RSA signs are not used in many countries.

RSA signs have a variety of different visual implementations, depending on regulations/specifications of the country where such signs are located. As for usage, in location such as in the US, the signs are found on rural road when approaching an incorporated municipality from an unincorporated locality (i.e., approaching a more populated/busy area from a less populated/busy area). However, even in countries and municipalities where RSA signs are typically used, they are often not uniformly placed with respect to the following reduced speed zone, which can lead to drivers being surprised by a posted sign for a lower speed and having to decelerate uneconomically with respect to energy utilization/recover efficiency to avoid speeding. Furthermore, even with known computer vision technology used to read speed limit signs (sometimes referred to as traffic sign recognition (TSR)), it is possible to misclassify a RSA sign as a sign for a legal speed limit.

Therefore, implementation of functionality for notifying a driver of an approaching segment of roadway with a lower legal speed limit is beneficial, desirable, and useful.

SUMMARY OF THE DISCLOSURE

Embodiments of the present invention relate to implementations of functionality for notifying a driver of an approaching segment of a roadway with a lower legal (e.g., posted) speed limit. More specifically, embodiments of the present invention display a virtual reduce speed ahead (RSA) sign to advise a driver of a vehicle of an approaching segment of a roadway with a lower speed limit than a current segment of the roadway. Advantageously, such display of a virtual RSA sign can be deployed along any route, can enhance safety and convenience in regions of the world that do not utilize RSA signs, can be displayed at an adjustable/variable distance from a corresponding speed limit sign for a section of roadway with a lower speed limit that a current segment of the roadway, can be configured to be unambiguous with respect to other configurations of speed limit signage, and can be integrated into traffic sign recognition functionality. Accordingly, implementation of RSA information delivery functionality is beneficial, desirable, and useful.

In one embodiment of the present invention, a method comprises a plurality of operations. Operations are performed for determining a position of a vehicle on a segment of a roadway over which the vehicle is currently travelling, for identifying a change in speed limit for a segment of the roadway that the vehicle is approaching relative to the current segment of the roadway, and for assessing speed limit information of the current segment of the roadway and the approaching segment of the roadway. After a determination is made that a speed limit of the approaching segment of the roadway is lower than at least one of a speed limit of the current segment of the roadway and a current speed of the vehicle, an operation is performed for determining a speed limit information presentation zone of the current segment of the roadway within which speed limit information for the approaching segment is to be presented to a driver of the vehicle. Thereafter, an operation is performed for assessing a position of the vehicle relative to the speed limit information presentation zone. In response to determining that the vehicle is within the speed limit information presentation zone, an operation is performed for providing the speed limit information for the approaching segment of the roadway to the driver.

In another embodiment of the present invention, a vehicle comprises a navigation system and a traffic sign recognition system. The navigation system provides a position of the vehicle on a segment of a roadway over which the vehicle is currently travelling and identifies a change in speed limit for a segment of the roadway that the vehicle is approaching relative to the current segment of the roadway. The traffic sign recognition system determines a speed limit information presentation zone of the current segment of the roadway within which speed limit information for the approaching segment is to be presented to a driver of the vehicle after determining that a speed limit of the approaching segment of the roadway is lower than a speed limit of the current segment of the roadway and/or a current speed of the vehicle. Thereafter, the traffic sign recognition system assesses the position of the vehicle relative to the speed limit information presentation zone. In response to determining that the vehicle is within the speed limit information presentation location, the traffic sign recognition system displays a visual representation of a speed limit sign designating the speed limit of the approaching segment of the roadway.

In another embodiment of the present invention, a processor-readable medium has tangibly embodied thereon and accessible therefrom a set of instructions interpretable by at least one data processing device. The processor-readable medium is non-transitory. The set of instructions is configured for causing the at least one data processing device to carry out various operations. The set of instructions cause operations to be performed for determining a position of a vehicle on a segment of a roadway over which the vehicle is currently travelling, for identifying a change in speed limit for a segment of the roadway that the vehicle is approaching relative to the current segment of the roadway, and for assessing speed limit information of the current segment of the roadway and the approaching segment of the roadway. After a determination is made that a speed limit of the approaching segment of the roadway is lower than at least one of a speed limit of the current segment of the roadway and a current speed of the vehicle, the set of instructions cause an operation to be performed for determining a speed limit information presentation zone of the current segment of the roadway within which speed limit information for the approaching segment is to be presented to a driver of the vehicle. Thereafter, the set of instructions cause an operation to be performed for assessing a position of the vehicle relative to the speed limit information presentation zone. In response to determining that the vehicle is within the speed limit information presentation zone, the set of instructions cause an operation to be performed for causing the speed limit information for the approaching segment of the roadway to be presented to the driver.

These and other objects, embodiments, advantages and/or distinctions of the present invention will become readily apparent upon further review of the following specification, associated drawings and appended claims.

BRIEF DESCRIPTION OF THE DRAWINGS

FIG. 1 is a flow diagram showing a method for providing reduce speed ahead (RSA) information delivery functionality in accordance with an embodiment of the present invention.

DETAILED DESCRIPTION OF THE DRAWING FIGURES

Figure 2:
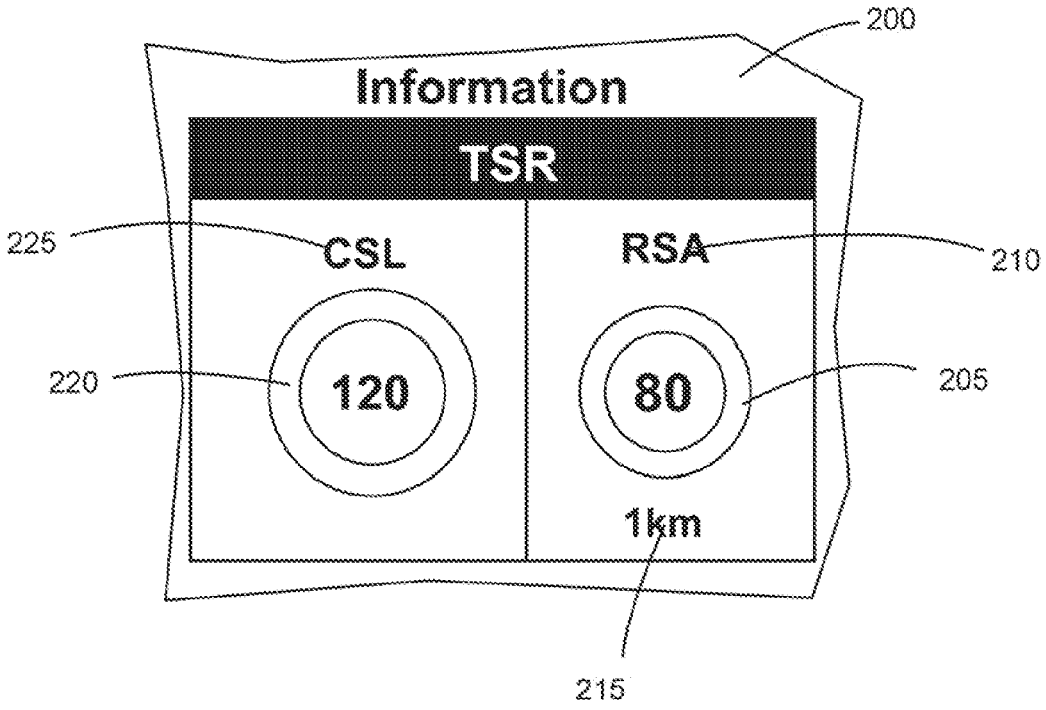
FIG. 2 is an illustrative view showing a visual display having displayed thereon speed limit information as provided by RSA information delivery functionality configured in accordance with an embodiment of the present invention.

FIG. 1 shows a method 100 for providing reduce speed ahead (RSA) information delivery functionality in accordance with an embodiments of the present invention. The objective of the method 100, which is performed in a repetitive manner as the vehicle is travelling down a roadway, is to present a driver of a vehicle with information relating to a speed limit of an approaching segment of roadway over which the vehicle is currently travelling. In particular, when a speed limit of the approaching segment of roadway is lower than a current speed of the vehicle and/or a speed limit of the current segment of the roadway, the driver is presented with information indicating that the approaching segment of the roadway has a lower speed limit than the current segment of the roadway. As will be disclosed in greater detail below, this information can be presented in any number of forms including, for example, a visual representation of a speed limit sign with the corresponding speed limit shown (e.g., a visual RSA sign), an audible message notifying the driver of the approaching reduction in speed limit, and/or haptically using a sensory signal (e.g., vibration in the accelerator pedal). Furthermore, this information can be presented as a function of a particular predefined position of the vehicle relative to speed limit site for the approaching segment of the roadway and/or a position derived using variable information relating to, for example, the speed of the vehicle, the speed limit of the approaching segment of the roadway, and deceleration of the vehicle as it nears the approaching segment of the roadway.

RSA signs (i.e., road signs posting a speed limit for an approaching segment of a roadway) are not used in many countries. However, even in countries and municipalities where RSA signs are typically used, they are often not uniformly placed with respect to the following reduced speed zone, which can lead to drivers being surprised by a posted sign for a lower speed and having to decelerate uneconomically with respect to energy utilization/recover efficiency to avoid speeding. Furthermore, even with known computer vision technology used to read speed limit signs (sometimes referred to as traffic sign recognition (TSR), it is possible to misclassify a RSA sign as a sign for a posted legal speed limit. Accordingly, in view of the disclosures made herein, a skilled person will appreciate that embodiments of the present invention are beneficial with regard to roadway safety and to reducing the potential for speeding violations.

The method 100 begins with an operation 102 being performed for determining a position of the vehicle on the current segment of the roadway, followed by an operation 104 being performed for identifying a speed limit change for the approaching segment of the roadway relative to the current segment of the roadway. It is disclosed herein that the operations for determining the position of the vehicle and for identifying the speed limit change can be performed by a navigation system of the vehicle through use of a map database thereof. Thereafter, an operation 106 is performed for assessing speed limit information of the current segment of the roadway and the approaching segment of the roadway. Such assessment includes determining if the speed limit of the approaching segment of the roadway is lower than either the speed limit of the current segment of the roadway or a current speed of the vehicle (e.g., as indicated via a vehicle speed sensor signal, a global positioning system (GPS) signal of navigation system, or the like).

After (e.g., in response to) a determination being made that a speed limit of the approaching segment of the roadway is lower than the speed limit of the current segment of the roadway and/or a current speed of the vehicle, an operation 108 is performed for determining a distance between the vehicle and the speed limit sign for the approaching segment of the roadway (e.g., by the navigation system), followed by an operation 110 being performed for determining a speed limit information presentation zone of the current segment of the roadway within which speed limit information for the approaching segment is to be presented to the driver of the vehicle (e.g., by a traffic sign recognition system of the vehicle). The speed limit information presentation zone corresponds to a distance as measured from a location of a speed limit sign posting the speed limit for the approaching segment of the roadway. A speed limit of the approaching segment of the roadway and a distance from the vehicle to a speed limit sign posting such speed limit are examples of the speed limit information for the approaching segment. The speed limit sign of the approaching segment of the roadway defines a far-end end point of the speed limit information presentation zone with respect to a current position of the vehicle. A length of the speed limit information presentation zone can be a preset distance or a distance that is a function of variable information relating to, for example, the speed of the vehicle, the speed limit of the approaching segment of the roadway, and/or desired/ideal deceleration of the vehicle as it nears the approaching segment of the roadway. It is disclosed herein that, in other embodiments, the operation 108 for determining the distance between the vehicle and the speed limit sign for the approaching segment of the roadway and the operation 110 for determining the speed limit information presentation zone can be performed in parallel rather than sequentially. Similarly, it is disclosed herein that the operation 108 for determining the distance between the vehicle and the speed limit sign for the approaching segment of the roadway can be performed after the operation 110 for determining the speed limit information presentation zone.

After the operation 108 for determining the distance between the vehicle and the speed limit sign for the approaching segment of the roadway and the operation 110 for determining the speed limit information presentation zone are performed, an operation 112 is performed for assessing a position of the vehicle relative to the speed limit information presentation zone such as, for example, by a vehicle speed sensor signal, a global positioning system (GPS) signal of navigation system, or the like. If it is determined that the vehicle is not within the speed limit information presentation zone, the method 100 continues at the operation 102 for determining the position of the vehicle on the current segment of the roadway. Otherwise, in response to determining that the vehicle is within the speed limit information presentation zone, an operation 114 is performed for providing the speed limit information for the approaching segment of the roadway to the driver. In a particular embodiment of the present invention, as shown in FIG. 2, providing the speed limit information includes displaying such information on a visual display 200 of the vehicle (i.e., a liquid crystal display (LCD) that the traffic sign recognition system uses for displaying information thereof). The speed limit information can include a visual representation of a speed limit sign 205 showing the speed limit of the approaching segment of the roadway, indicia 210 indicating that the visual representation of the speed limit sign 205 showing the speed limit of the approaching segment of the roadway corresponds to a reduce speed ahead condition, indicia 215 indicating a current distance to the speed limit sign posting the speed limit of the approaching segment of the roadway, a visual representation of a speed limit sign 220 showing the speed limit of the current segment of the roadway, and/or indicia indicating that the visual representation of the speed limit sign 220 showing the speed limit of the approaching segment of the roadway corresponds to a legal speed limit of the current segment of the roadway.

At an operation 116, an assessment is made as to whether the vehicle has passed the speed limit sign location for the approaching segment of the road if it is determined that the vehicle is past the speed limit sign of the approaching segment of the roadway (i.e., vehicle is now beyond the speed limit information presentation zone and is travelling on what was previously the approaching segment of the roadway), an operation 117 is performed for discontinuing the speed limit information for the approaching segment of the roadway being provided to the driver. Alternatively, if it is determined that the vehicle is within the speed limit information presentation zone, an operation 118 is performed for determining a speed limit warning zone on the roadway within which a warning notification indicating that the current speed of the vehicle is greater than the speed limit of the approaching segment of the roadway is to be provided to the driver. The speed limit warning zone is defined by a distance as measured from the location of the speed limit sign posting the speed limit for the approaching segment of the roadway whereby the speed limit sign of the approaching segment of the roadway defines a far-end point of the speed limit warning zone with respect to a current position of the vehicle. Similar to the speed limit information presentation-zone discussed above, a length of the speed limit warning zone can be a preset distance or a distance that is a function of variable information relating to, for example, the speed of the vehicle, the speed limit of the approaching segment of the roadway, and/or maximum desired deceleration of the vehicle as it nears the approaching segment of the roadway. Although speed limit signs configured in accordance with European specifications are shown herein, a skilled person will appreciate that embodiments of the present invention are not unnecessarily limit to utility and/or operability with speed limit signs of any particular national or regional specification.

Figure 3:
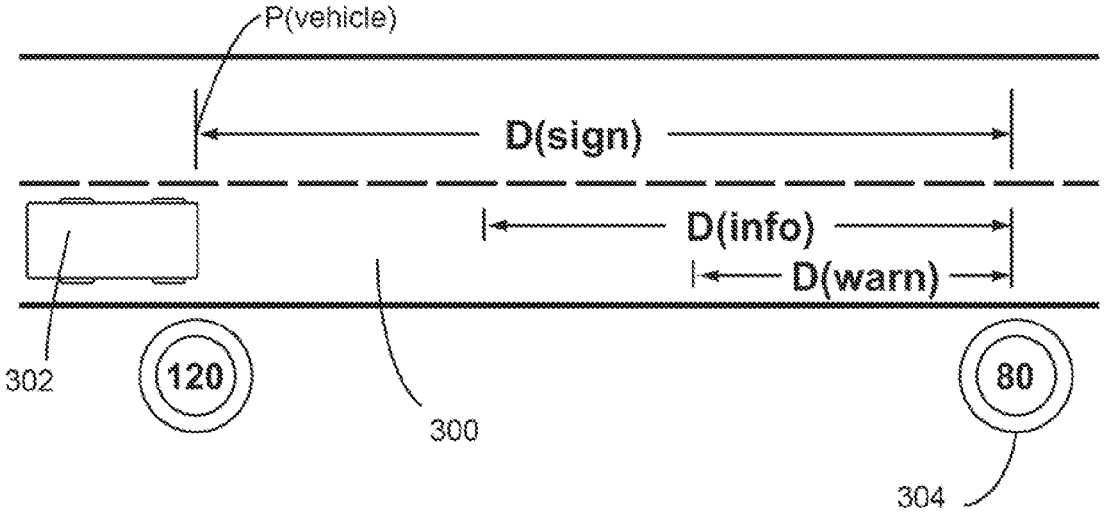
FIG. 3 is an illustrative view showing a speed limit information presentation zone and a speed limit warning zone as provided for by RSA information delivery functionality configured in accordance with an embodiment of the present invention.

As shown in FIG. 3, speed limit information presentation zone D(Info) and the speed limit warning zone D(warn) jointly allow for information regarding an approaching segment of a roadway 300 to be presented in a dynamic fashion to the driver of the vehicle 302. As the vehicle travels toward the speed limit sign 304 for the approaching segment of the roadway, the distance between the vehicle and the speed limit sign for the approaching segment of the roadway (i.e., the speed limit information presentation zone D(Info)) as defined by the vehicle position P(vehicle) is determined (e.g., via the operation 108 of the method 100). In conjunction with determining the distance between the vehicle and the speed limit sign for the approaching segment of the roadway, the speed limit information presentation zone D(Info) is determined (e.g., via the operation 110 of the method 100). Prior to or after the vehicle entering the speed limit information presentation zone D(Info), speed limit information is presented to the driver (e.g., as shown above in FIG. 2) and the speed limit warning zone D(warn) is determined (e.g., via the operation 118 of the method 100). Accordingly, after the vehicle enters the speed limit warning zone D(warn), a warning relating to the lower speed limit of the approaching segment of the roadway can be provided to the driver of the vehicle.

As has been previously discussed, a length of the speed limit warning zone D(warn) can be a distance that is a function of variable information relating to the speed of the vehicle, the speed limit of the approaching segment of the roadway, and deceleration of the vehicle as it nears the approaching segment of the roadway. In a preferred embodiment, a length of the speed limit warning zone D(warn) is a distance defined by the following equation, where V(current) is the greater of the current speed of the vehicle and the current speed limit, V(new) is the speed limit of the approaching segment of the roadway, and A is a tuneable parameter corresponding to the acceleration threshold used to determine the D(warn) point. Accordingly, the speed limit warning zone D(warn) is longer to provide for earlier warning when the deceleration parameter A is smaller (e.g., for average deceleration of 0.1 G, A=1 m/s^2), and is shorter to provide for later warning when the deceleration parameter A is set larger (e.g., average deceleration of 0.5 G, A=5 m/s^2).

$$D(\text{warn}) = \frac{V(\text{current})^2 - V(\text{new})^2}{2A}.$$

Returning to FIG. 1, after determining the speed limit warning zone, an operation 120 is performed for assessing the position of the vehicle relative to the speed limit warning zone such as, for example, by a vehicle speed sensor signal, a global positioning system (GPS) signal of navigation system, or the like. If it is determined that the vehicle is within the speed limit warning zone, an operation 122 is performed for providing the speed limit warning. Examples the speed limit warning include, but are not limited to, a highlighting or other visual effect (e.g., blinking) of a displayed visual representation of the speed limit sign for the approaching segment of the roadway, an audible message warning the driver of the speed limit of the approaching segment of the roadway and/or the current speed of the vehicle, and/or a haptic response at a vehicle control structure (e.g., vibration in the accelerator pedal). If it is determined that the vehicle is not within the speed limit warning zone (e.g., driver has decelerated), an operation 124 is performed assessing the current speed limit warning state. If it is determined that the speed limit warning is currently being provided, an operation 126 is performed for discontinuing the speed limit warning, if necessary. The method 100 continues at the operation 116 for assessing the vehicle position relative to the speed limit sign of the approaching segment of the roadway after any one of the following: 1.) determining that the vehicle is no longer in the speed limit warning zone at the operation 120, 2.) providing the speed limit warning at the operation 122, and 3.) discontinuing the speed limit warning at the operation 126. Thereafter, if it is determined that the vehicle is not past the speed limit sign, the speed limit warning loop of the method 100 is performed again (i.e., operations 118-128). Otherwise, the method 100 continues at the operation 117 for discontinuing the speed limit information for the approaching segment of the roadway being provided to the driver.

Figure 4:
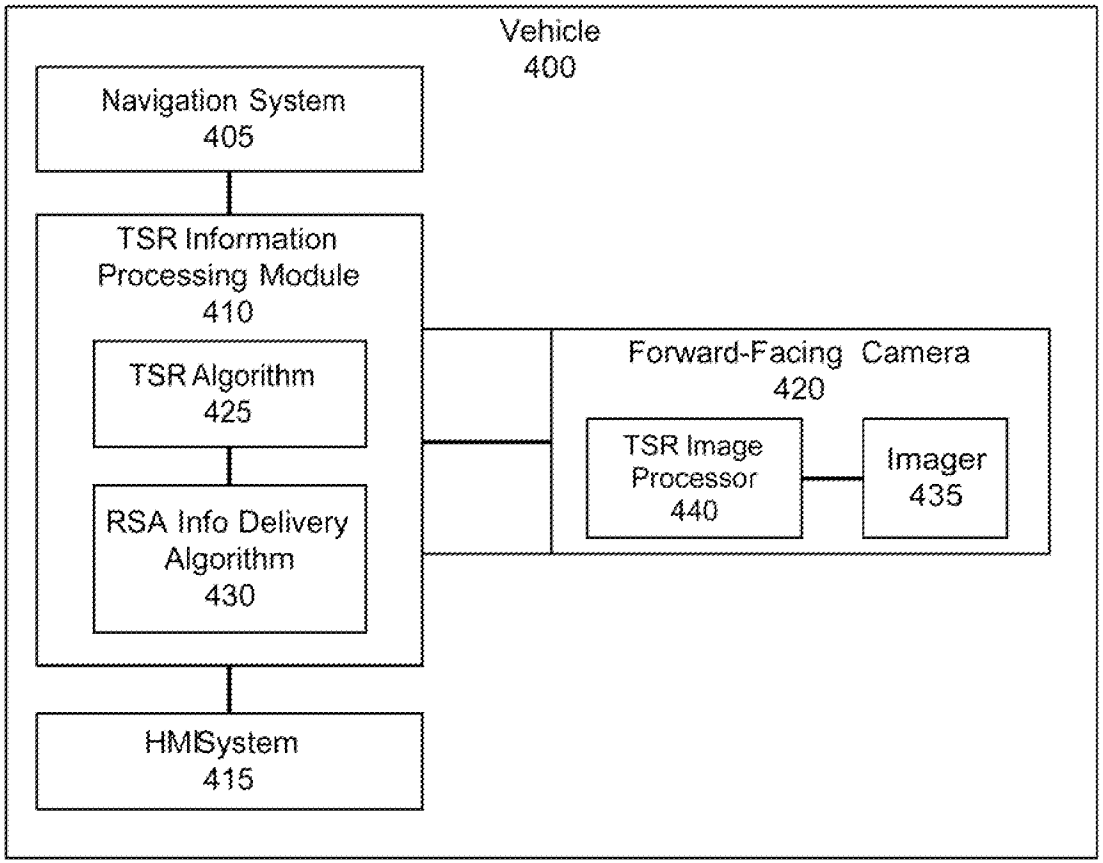
FIG. 4 is a block diagram showing a vehicle configured for providing RSA information delivery functionality in accordance with an embodiment of the present invention.

Referring now to FIG. 4, a vehicle 400 is configured for providing RSA information delivery functionality in accordance with an embodiment of the present invention. The vehicle 400 includes a navigation system 405, a traffic sign recognition (TSR) information processor 410, a human machine interface (HMI) system 415, and a forward-facing camera 420. The TSR information processor 410 is coupled between the navigation system 405, the human machine interface (HMI) system 415, and the forward-facing camera 420 such as, for example, via a controller area network (CAN) of the vehicle 400. Accordingly, information can be communicated between the navigation system 405, the TSR information processor 410, the HMI system 415, and the forward-facing camera 420.

The TSR information processor 410 includes a TSR algorithm 425 and a RSA information delivery algorithm 430 coupled to the TSR algorithm 425. The forward-facing camera 420 includes an imager 435 and a TSR image processor 440. It is disclosed herein that that the TSR information processor 410 can be part of the forward-facing camera 420. The imager 435 captures an image of objects ahead of the vehicle 400. The TSR image processor 440 receives the image (e.g., a signal containing data representing the image) from the imager 435 and assesses such image for determining (i.e., recognizing) any traffic sign(s) within the image. A signal representing such recognized sign or signs is provided from the TSR image processor 440 to the TSR Information processor 410. The TSR algorithm causes a visual presentation of information pertaining to such sign or signs to be presented to the driver of the vehicle via the HMI system 415. In a preferred embodiment, a visual representation of such sign or signs is displayed on a visual display of the HMI system 415. In view of the disclosures made herein, a skilled person will appreciate that the navigations system 405 or optionally a different system (e.g., a electronic horizon system/provider) can provide necessary map data.

With specific regard to RSA information delivery functionality in accordance with an embodiment of the present invention, the TSR algorithm 425 and the RSA information delivery algorithm 430 jointly cause speed limit information and speed limit warnings to be provided to the driver of the vehicle via the HMI system 415. Positional information necessary for implementing the RSA information delivery functionality is provided to the TSR information processor 410 by the navigation system (e.g., as generated by a global positioning system, dead reckoning, and/or map databases matching thereof). To this end, the TSR algorithm 425 and the RSA information delivery algorithm 430 each comprise instructions for carrying out operations associated with their respective functionalities. Such instructions, which can be stored on memory of the TSR information processor 410 and/or elsewhere, are accessible from such memory and processible by one of more data processing devices of the TSR information processor 410. Such instructions of the TSR algorithm 425 can be configured to provide a position of the vehicle on a segment of a roadway over which the vehicle is currently travelling and to identify a change in speed limit for a segment of the roadway that the vehicle is approaching relative to the current segment of the roadway. Correspondingly, such instructions of the RSA information delivery algorithm 430 can be configured to determine if a speed limit of the approaching segment of the roadways is lower than a speed limit of the current segment of the roadway and/or a current speed of the vehicle, to determine a speed limit information presentation zone within which speed limit information for the approaching segment is to be presented to a driver of the vehicle, to assess the position of the vehicle relative to the speed limit information presentation zone, and to provide speed limit information to the driver when it is determined that the vehicle is within the speed limit information presentation zone. Such instructions of the RSA information delivery algorithm 430 can also be configured to determine a speed limit warning zone, to assess the position of the vehicle relative to the speed limit warning zone, and to causing a speed limit warning to be provided to the driver when it is determined that the vehicle is within the speed limit warning zone. It is disclosed herein that the present invention is not unnecessarily limited to being implement in any particular module, computer, or other component of a vehicle. Accordingly, it is disclosed herein that RSA information delivery functionality can be implemented in a vehicle using any available and suitable configured module, computer, and/or other data/information processing component of the vehicle.

Referring now to instructions processible by a data processing device, it will be understood from the disclosures made herein that methods, processes and/or operations adapted for carrying out RSA information delivery functionality as disclosed herein are tangibly embodied by computer readable medium having instructions thereon that are configured for carrying out such functionality. In one specific embodiment, the instructions are tangibly embodied for carrying out the method 100 disclosed above. The instructions may be accessible by one or more data processing devices from a memory apparatus (e.g. RAM, ROM, virtual memory, hard drive memory, etc), from an apparatus readable by a drive unit of a data processing system (e.g., a diskette, a compact disk, a tape cartridge, etc) or both. Accordingly, embodiments of computer readable medium in accordance with the present invention include a compact disk, a hard drive, RAM or other type of storage apparatus that has imaged thereon a computer program (i.e., instructions) adapted for carrying out RSA information delivery functionality in accordance with the present invention. In a preferred embodiment, one or more control modules and/or computers of a vehicle comprises the memory from which RSA information delivery functionality instruction are accessible and comprises one or more data processing devices that access and carry out such instructions. Accordingly, it is disclosed herein that RSA information delivery functionality in accordance with the present invention in not unnecessarily limited to being implement in any particular module, computer, or other component of a vehicle.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method, comprising:

determining a position of a vehicle on a segment of a roadway over which the vehicle is currently travelling;

identifying a change in speed limit for a segment of the roadway that the vehicle is approaching relative to the current segment of the roadway;

assessing speed limit information of the current segment of the roadway and the approaching segment of the roadway;

determining a speed limit information presentation zone of the current segment of the roadway within which speed limit information for the approaching segment of the roadway is to be presented to a driver of the vehicle after determining that a speed limit of the approaching segment of the roadway is lower than at least one of a speed limit of the current segment of the roadway and a current speed of the vehicle;

assessing a position of the vehicle relative to the speed limit information presentation zone;

determining a speed limit warning zone on the roadway within which a notification indicating that the current speed of the vehicle is greater than the speed limit of the approaching segment of the roadway is presented to the driver, the speed limit warning zone having a warning notification distance, defining a distance at which the driver is initially notified of the change in speed limit, that is a function of the current speed of the vehicle, the speed limit for the approaching segment of the roadway and a vehicle deceleration factor including a measured deceleration of the vehicle corresponding to an actual deceleration of the vehicle at a point in time such that the measured deceleration of the vehicle influences a magnitude of the warning notification distance;

assessing the position of the vehicle relative to the speed limit warning zone; and providing the speed limit information for the approaching segment of the roadway to the driver in response to determining that the vehicle is within the speed limit information presentation zone.

2. The method of claim 1 wherein providing the speed limit information includes displaying a visual representation of a speed limit sign showing the speed limit of the approaching segment of the roadway.

3. The method of claim 2 wherein displaying the visual representation of the speed limit sign showing the speed limit of the approaching segment of the roadway includes displaying the visual representation of the speed limit sign showing the speed limit of the approaching segment of the roadway adjacent to a visual representation of a speed limit sign showing the speed limit of the current segment of the roadway over which the vehicle is currently travelling.

4. The method of claim 2 wherein displaying the visual representation of the speed limit sign showing the speed limit of the approaching segment of the roadway includes displaying the visual representation of the speed limit sign on a visual display of a traffic sign recognition system of the vehicle.

5. The method of claim 1 wherein providing the speed limit information includes displaying a visual representation of a speed limit sign showing the speed limit of the approaching segment of the roadway.

6. The method of claim 5 wherein displaying the visual representation of the speed limit sign showing the speed limit of the approaching segment of the roadway includes displaying the visual representation of the speed limit sign showing the speed limit of the approaching segment of the roadway adjacent to a visual representation of a speed limit sign showing the speed limit of the current segment of the roadway over which the vehicle is currently travelling.

7. The method of claim 5 wherein displaying the visual representation of the speed limit sign showing the speed limit of the approaching segment of the roadway includes displaying the visual representation of the speed limit sign on a visual display of a traffic sign recognition system of the vehicle.

8. A vehicle, comprising:

a navigation system configured to provide a position of the vehicle on a segment of a roadway over which the vehicle is currently travelling and identify a change in speed limit for a segment of the roadway that the vehicle is approaching relative to the current segment of the roadway; and a traffic sign recognition system configured to determine a speed limit information presentation zone of the current segment of the roadway within which speed limit information for the approaching segment of the roadway is to be presented to a driver of the vehicle after determining that a speed limit of the approaching segment of the roadway is lower than at least one of a speed limit of the current segment of the roadway and a current speed of the vehicle; wherein the traffic sign recognition system is configured to determine a speed limit warning zone on the roadway within which a warning notification indicating that the current speed of the vehicle is greater than the speed limit of the approaching segment of the roadway is to be presented to the driver, the speed limit warning zone having a warning notification distance, defining a distance at which the driver is initially notified of the change in speed limit, that is a function of the current speed of the vehicle, the speed limit of the approaching segment of the roadway and a vehicle deceleration factor including a measured deceleration of the vehicle corresponding to an actual deceleration of the vehicle at a point in time such that the measured deceleration of the vehicle influences a magnitude of the warning notification distance; and wherein the traffic sign recognition system is configured to assess the position of the vehicle relative to the speed limit information presentation zone, and display a visual representation of a speed limit sign designating the speed limit of the approaching segment of the roadway in response to determining that the vehicle is within the speed limit information presentation zone.

9. The vehicle of claim 8 wherein:

the traffic sign recognition system includes a visual display for displaying the visual representation of the speed limit sign on the visual display of the traffic sign recognition system.

10. The vehicle of claim 8 wherein the visual representation of the speed limit sign includes the visual representation of the speed limit sign adjacent to a visual representation of a speed limit sign showing the speed limit of the current segment of the roadway over which the vehicle is currently travelling.

11. The vehicle of claim 8 wherein:

the traffic sign recognition system includes a visual display for displaying the visual representation of the speed limit sign on the visual display of the traffic sign recognition system.

12. The vehicle of claim 8 wherein the visual representation of the speed limit sign includes the visual representation of the speed limit sign adjacent to a visual representation of a speed limit sign showing the speed limit of the current segment of the roadway over which the vehicle is currently travelling.

13. A processor-readable medium having tangibly embodied thereon and accessible therefrom a set of instructions interpretable by at least one data processing device, the processor-readable medium being non-transitory, and the set of instructions configured for causing the at least one data processing device to carry out operations for:

determining a position of a vehicle on a segment of a roadway over which the vehicle is currently travelling;

identifying a change in speed limit for a segment of the roadway that the vehicle is approaching relative to the current segment of the roadway;

assessing speed limit information of the current segment of the roadway and the approaching segment of the roadway;

determining a speed limit information presentation zone of the current segment of the roadway within which speed limit information for the approaching segment is to be presented to a driver of the vehicle after determining that a speed limit of the approaching segment of the roadway is lower than at least one of a speed limit of the current segment of the roadway and a current speed of the vehicle;

assessing a position of the vehicle relative to the speed limit information presentation zone;

determining a speed limit warning zone on the roadway within which a warning notification indicating that the current speed of the vehicle is greater than the speed limit of the approaching segment of the roadway is to be provided to the driver, the speed limit warning zone having a warning notification distance, defining a distance at which the driver is initially notified of the change in seed limit, that is a function of the current speed of the vehicle, the speed limit of the approaching roadway and a deceleration factor including a measured deceleration of the vehicle corresponding to an actual deceleration of the vehicle at a point in time such that the measured vehicle deceleration influences a magnitude of the warning notification distance;

assessing the position of the vehicle relative to the speed limit warning zone;

causing the warning notification to be provided to the driver in response to determining that the vehicle is within the speed limit warning zone; and causing the speed limit information for the approaching segment of the roadway to be presented to the driver in response to determining that the vehicle is within the speed limit information presentation zone.

14. The processor-readable medium of claim 13 wherein causing the speed limit information for the approaching segment to be presented to the driver includes causing a visual representation of a speed limit sign showing the speed limit of the approaching segment of the roadway to be displayed.

15. The processor-readable medium of claim 14 wherein causing a visual representation of a speed limit sign showing the speed limit of the approaching segment of the roadway to be displayed includes causing the visual representation of the speed limit sign showing the speed limit of the approaching segment of the roadway to be displayed adjacent to a visual representation of a speed limit sign showing the speed limit of the current segment of the roadway over which the vehicle is currently travelling.

16. The processor-readable medium of claim 14 wherein causing the visual representation of the speed limit sign showing the speed limit of the approaching segment of the roadway to be displayed includes causing the visual representation of the speed limit sign to be displayed on a visual display of a traffic sign recognition system of the vehicle.

17. The processor-readable medium of claim 13 wherein causing the speed limit information for the approaching segment of the roadway to be presented to the driver includes causing a visual representation of a speed limit sign showing the speed limit of the approaching segment of the roadway to be displayed.

18. The processor-readable medium of claim 17 wherein causing a visual representation of a speed limit sign showing the speed limit of the approaching segment of the roadway to be displayed includes causing the visual representation of the speed limit sign showing the speed limit of the approaching segment of the roadway to be displayed adjacent to a visual representation of a speed limit sign showing the speed limit of the current segment of the roadway over which the vehicle is currently travelling.

19. The processor-readable medium of claim 17 wherein causing the visual representation of the speed limit sign showing the speed limit of the approaching segment of the roadway to be displayed includes causing the visual representation of the speed limit sign to be displayed on a visual display of a traffic sign recognition system of the vehicle.

* * * * *